United States Patent [19]

Su-Chin

[11] Patent Number: 4,884,689

[45] Date of Patent: Dec. 5, 1989

[54] FLEXIBLE TOOL CASE ACCESSORIES COMPARTMENT ASSEMBLY STRUCTURE

[76] Inventor: Chen Su-Chin, 4F., No. 131, Kwei Lin Road, Taipei, Taiwan

[21] Appl. No.: 315,870

[22] Filed: Feb. 27, 1989

[51] Int. Cl.[4] ..... B65D 1/24

[52] U.S. Cl. ..... 206/372; 206/561; 220/22.1

[58] Field of Search ..... 206/387, 372, 561, 557, 206/560; 220/22, 22.1, 334, 315

[56] References Cited

U.S. PATENT DOCUMENTS

| | | | |
|---|---|---|---|
| D. 221,409 | 8/1971 | Gerber | 206/387 |
| 1,630,140 | 5/1927 | Sibbald | 206/224 |
| 3,698,404 | 10/1972 | Greco | 220/22.1 |
| 4,432,453 | 2/1984 | Berkman | 206/387 |
| 4,779,752 | 10/1988 | Vauer et al. | 220/22.1 |
| 4,781,423 | 11/1988 | Muenzer et al. | 220/22.1 |

*Primary Examiner*—Joseph Man-Fu Moy
*Attorney, Agent, or Firm*—Varndell Legal Group

[57] ABSTRACT

A flexible tool case accessories compartment assembly structure wherein the compartments in the tool case for collection of a variety of accessories are flexibly arranged according to requirement. It is to integrally made an inner receiving space inside a tool case on either corner with the inner side wall of the receiving space integrally made to provide a plurality of vertical grooves arranged at equal interval to match with a variety of stake racks which are also integrally made to provide a plurality of vertical grooves arranged at equal interval, such that the receiving space may be flexibly divided into a variety of compartments in specific sizes to fit for specific requirements. A plurality of stop logs are made on the top of the receiving space around the periphery to define an opening at one side and to define a sliding way therebelow so as to let a cover board be set therein to cover the receiving space. There is provided a protruding side edge made on the opposite side of the tool case against the opening so as to block up the engaging and to let the cover board be firmly retained to cover the receiving space when the tool case is closed up.

1 Claim, 3 Drawing Sheets

FLEXIBLE TOOL CASE ACCESSORIES COMPARTMENT ASSEMBLY STRUCTURE

BACKGROUND AND SUMMARY OF THE INVENTION

In conventional tool cases, symmetrical receiving troughs are respectively made on two large opposite side walls of each tool case according to the shapes of a variety of tools so as to collect the respective tools therein for easy carriage and to prevent the tools from getting lost. However, while using tools, some accessories may be required, for example, all kinds of screws, nuts and washers etc. In conventional tool cases, there is no compartments designed for receiving specific accessories. In recent years, there is another kind of tool cases designed to provide accessories receiving troughs for collection of accessories. However, the accessories receiving troughs are of fixed type and not variable. It is really not practical to let the fixed receiving troughs be provided for collecting a variety of accessories. Because fixed type receiving troughs may be suitable for fixation of some parts and accessories but may be not suitable for others.

The main object of the present invention is to provide a flexible tool case accessories compartment assembly structure wherein a receiving space is made inside a tool case with the inner wall of the receiving space been integrally made to provide a plurality of vertical grooves arranged at equal interval to match with a variety of stake racks so as to allow the receiving space be flexibly divided into a variety of compartments to fit for flexible collection of a variety of accessories.

Another object of the present invention is to provide a flexible tool case accessories compartment assembly structure wherein an opening is made on one side of the receiving space adjacent to the side edge of the tool case so as to define a sliding way for setting therein of a cover board to slidably cover the receiving space so as to let the compartments in the receiving space be completely enclosed when the tool case is closed up.

Further objects, features and advantages of the present invention will become more apparent from the following detailed description in connection with the accompanying drawings as hereunder.

DETAILED DESCRIPTION OF THE PREFERRED EMBODIMENTS

Figure 1:
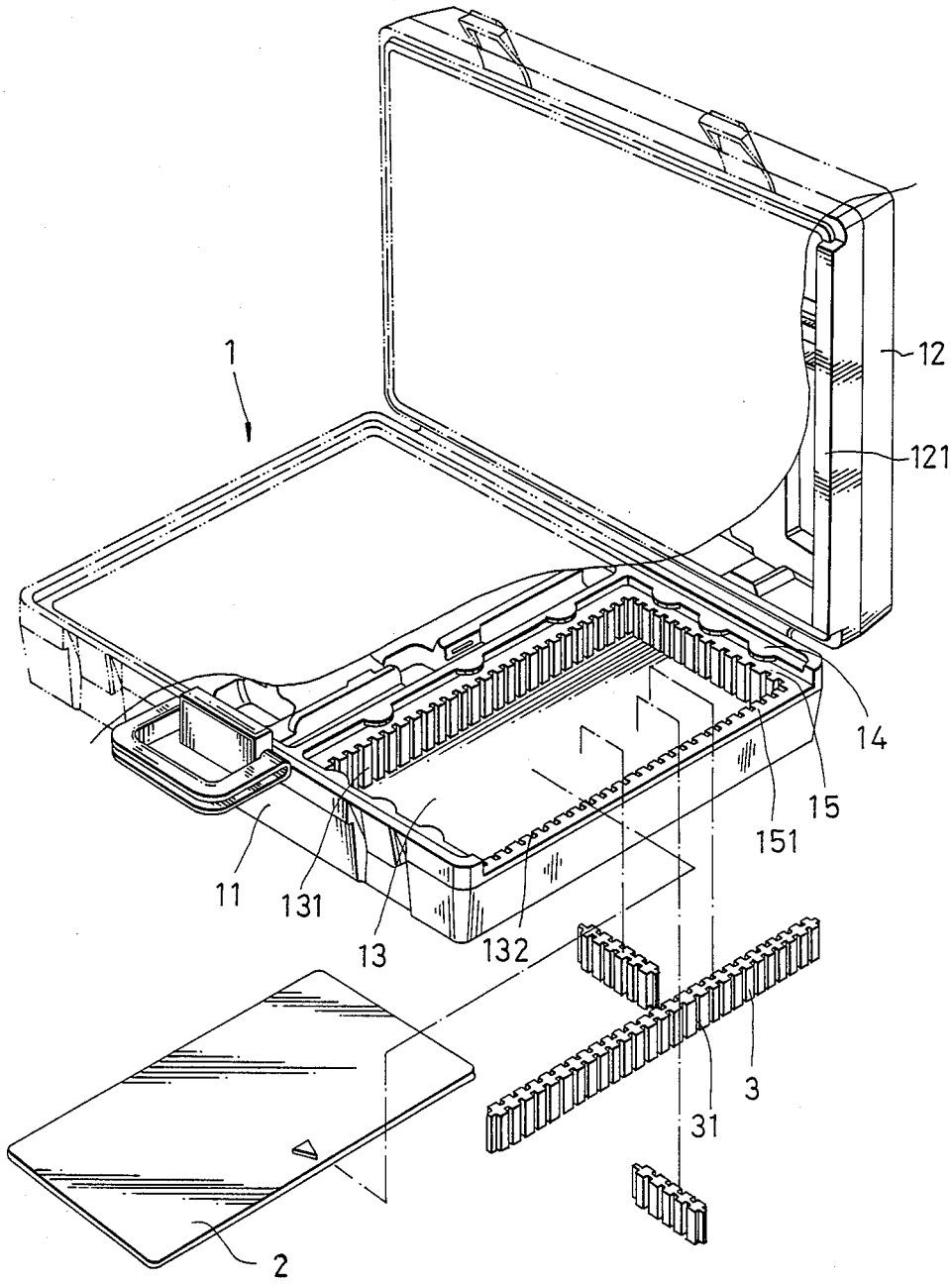
FIG. 1 is a perspective structural view of a tool case embodying the present invention.
Figure 2:
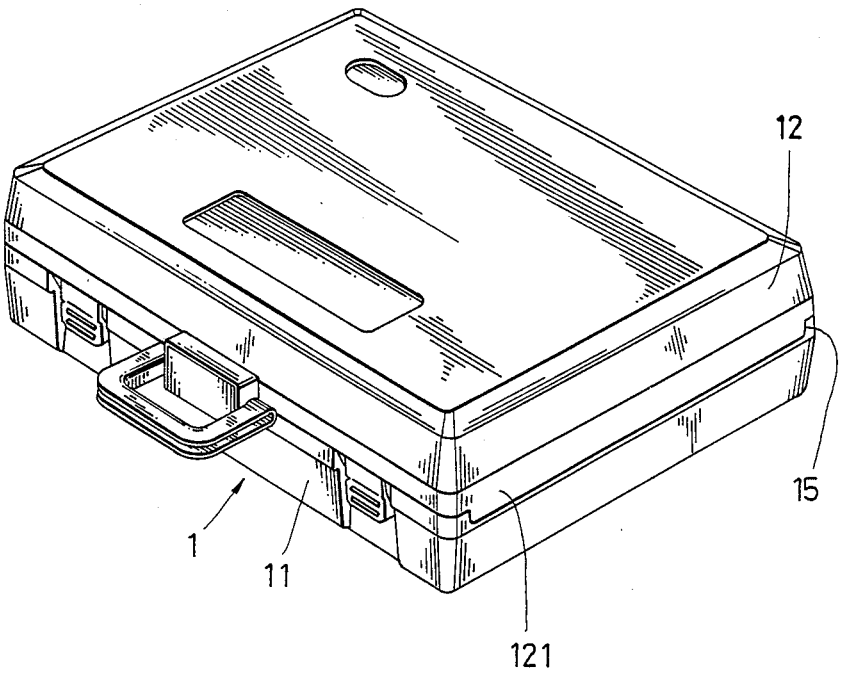
FIG. 2 illustrates an outer appearance of a tool case constructed according to the present invention.
Figure 3:
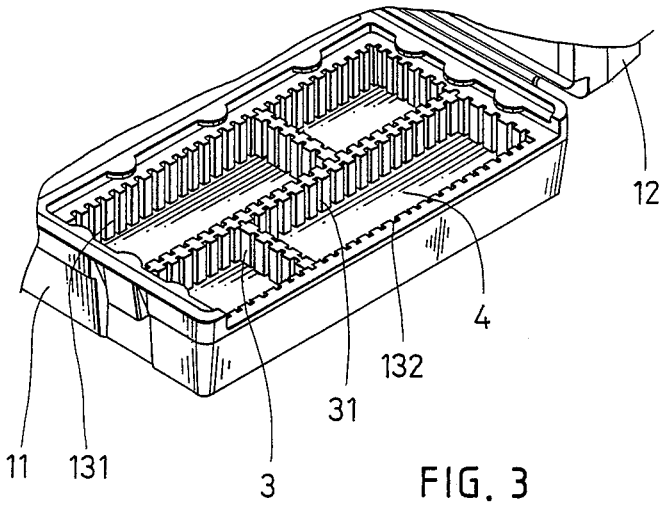
FIG. 3 is a schematic drawing illustrating one example of accessories compartment assembly.
Figure 4:
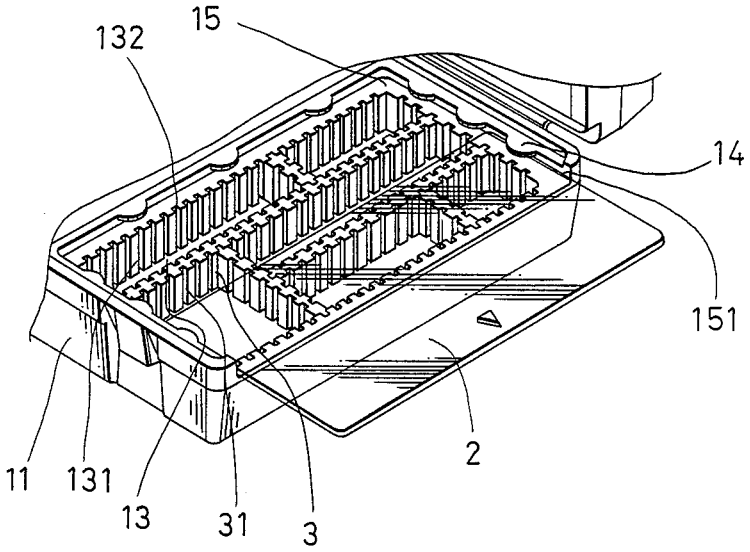
FIG. 4 is a schematic drawing illustrating another example of accessories compartment assembly.

FIG. 1 shows a perspective structural view of a tool case according to the present invention. A tool case 1 comprises two pivotally connected large opposite casings, that is, an upper and lower casings 12 and 11 to define a receiving space 13. A plurality of stop logs 14 are made on the periphery of the lower casing 11 to horizontally protrude inward so as to surround the receiving space 13 at the top and to define a horizontal sliding way 15 therebelow for setting therein of a cover board 2 from the opening 151 to cover the receiving space 13. The upper casing 12 comprises a protruding side edge 121 properly arranged to match with the opening 151 of the lower casing 11. When both upper and lower casings 11 and 12 are closed up, the protruding side edge 121 of the upper casing 12 fills up the opening 151 (as shown in FIG. 2) so as to firmly retain the cover board 2 in the sliding way 15 to tightly close up the receiving space 13. Therefore, during transportation or upon impact force, the cover board 2 does not slide away from its covering position over the receiving space 13. Further, there are a plurality of vertical grooves 132 made on the inner side wall 131 of the receiving space 13 at equal interval. A plurality of stake racks 3 in different length, which comprise a plurality of vertical grooves 31 arranged at equal interval, are provided to match with the grooved side wall 131 of the receiving space 13 so as to flexibly divide the receiving space 13 into a variety of accessories compartments 4 (as shown in FIGS. 3 and 4) according to actual requirements to fit for collection of a variety of parts, accessories and other articles. By means of this arrangement, the size of the accessories compartments 4 are properly set according to the articles to be collected so as to fully utilize the space.

I claim:

1. A flexible tool case accessories compartment assembly structure including a vertically grooved inner wall made on either corner inside a tool case to define a receiving space; a plurality of stake racks in different length having vertical grooves made thereon at equal interval, being provided to match with said vertically grooved inner wall so as to flexibly divide said receiving space into a variety of compartments; a plurality of stop logs being made on the top of said receiving space to surround said receiving space with one free side left as an opening so as to define a sliding way therebelow for a cover board to set therein from said opening to further cover said receiving space, said opening being arranged at one side edge of said tool case so as to allow said cover board be firmed retained to cover said receiving space when said tool case is closed up.

* * * * *